US012590755B2

(12) United States Patent
Leachman et al.

(10) Patent No.: US 12,590,755 B2
(45) Date of Patent: Mar. 31, 2026

(54) MULLION GUIDE ELEMENT FOR A REFRIGERATOR APPLIANCE

(71) Applicant: Haier US Appliance Solutions, Inc., Wilmington, DE (US)

(72) Inventors: William Jeremy Leachman, Pewee Valley, KY (US); Matthew William Davis, Prospect, KY (US); Jonathan Charles Crosby, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 56 days.

(21) Appl. No.: 18/678,927

(22) Filed: May 30, 2024

(65) Prior Publication Data

US 2025/0369681 A1 Dec. 4, 2025

(51) Int. Cl.
*F25D 23/02* (2006.01)

(52) U.S. Cl.
CPC ..... *F25D 23/028* (2013.01); *F25D 2323/021* (2013.01); *F25D 2400/06* (2013.01)

(58) Field of Classification Search
CPC ..... F25D 2323/021; F25D 2400/06; F25D 23/028; F25D 23/02; F25D 23/087; F25D 21/04; F25D 2400/04
See application file for complete search history.

(56) References Cited

U.S. PATENT DOCUMENTS

| | | | | |
|---|---|---|---|---|
| 3,017,657 | A * | 1/1962 | Mills | F24C 15/024 16/443 |
| 4,912,809 | A * | 4/1990 | Scheuer | F16B 9/058 16/443 |
| 6,205,616 | B1 * | 3/2001 | Hwang | E05D 7/1011 16/229 |
| 7,008,032 | B2 | 3/2006 | Chekal et al. | |
| 7,168,213 | B2 | 1/2007 | Rudduck et al. | |
| 8,167,389 | B2 | 5/2012 | Han et al. | |
| 8,444,238 | B2 | 5/2013 | Choi | |
| 10,808,982 | B2 | 10/2020 | Hanson | |
| 11,536,508 | B2 | 12/2022 | Avhale et al. | |
| 2004/0231103 | A1 * | 11/2004 | Magnuson | E05D 5/121 16/340 |
| 2009/0113927 | A1 * | 5/2009 | Laible | E05B 65/0042 62/449 |
| 2010/0071404 | A1 * | 3/2010 | Han | F25D 23/02 62/449 |
| 2012/0073321 | A1 | 3/2012 | Davis et al. | |
| 2014/0159560 | A1 * | 6/2014 | Jung | F25D 23/02 312/405 |
| 2016/0146528 | A1 * | 5/2016 | Yoon | F25D 23/028 62/277 |
| 2017/0030629 | A1 * | 2/2017 | Naik | F25D 23/02 |

(Continued)

*Primary Examiner* — Hiwot E Tefera
(74) *Attorney, Agent, or Firm* — Dority & Manning, P.A.

(57) ABSTRACT

A refrigerator appliance may include a cabinet defining a chamber. The refrigerator appliance may include a door rotatably hinged to the cabinet for accessing the chamber. The refrigerator appliance may include an articulating mullion rotatable coupled to the door. The articulating mullion may include a body. The refrigerator appliance may include a mullion guide element adjustably attached to the body. The mullion guide element may be vertically movable relative to the body to ensure proper engagement between the mullion guide element and the cabinet.

16 Claims, 8 Drawing Sheets

(56) References Cited

U.S. PATENT DOCUMENTS

| | | | | |
|---|---|---|---|---|
| 2017/0234606 | A1* | 8/2017 | Dubina | F25D 23/028<br>312/404 |
| 2018/0100657 | A1* | 4/2018 | Yantis | E05B 1/0015 |
| 2018/0209209 | A1* | 7/2018 | Ham | E06B 7/215 |
| 2019/0113276 | A1* | 4/2019 | Ebrom | F25D 21/04 |
| 2023/0085049 | A1* | 3/2023 | Farrel | F24C 15/024<br>126/273 R |

* cited by examiner

MULLION GUIDE ELEMENT FOR A REFRIGERATOR APPLIANCE

FIELD OF THE DISCLOSURE

The present subject matter relates generally to a refrigerator appliance, and more particularly to a guiding feature for a mullion of a refrigerator appliance.

BACKGROUND OF THE DISCLOSURE

Appliances, such as refrigerator appliances, often include one or more assemblies for sealing air therein. In the case of refrigerator appliances, one of the reasons for such a seal is to mitigate food spoilage, which presents significant health hazards and causes billions of dollars of waste around the world each year. Specifically, in order to prevent spoilage, refrigerators and freezers maintain foods at low temperatures. Properly sealing in the cold air while still allowing the consumer to easily access the freezer and fresh food compartments is one of the most important considerations in refrigerator design.

Many refrigerators provide one or more hinged doors for accessing the refrigerator cabinet. The doors generally include gaskets, which seal the door against the refrigerator cabinet when the door is closed. French-style doors are desirable because they reduce the weight load on the door hinge. French doors divide the cabinet opening in two, such that each door weighs less than a single door would weigh. That allows the size of the support structure of each door to be reduced. French doors also increase accessibility to the refrigerator cabinet and provide additional storage arrangements that are not possible with a single-door design.

However, one problem with French doors is that they require additional seals; in particular, the middle of the refrigerator opening (e.g., where the two doors meet) must maintain a seal when the doors are closed. Some French door refrigerators include a movable mullion attached to one of the doors such that access to the corresponding compartment via the respective opening is not obstructed by the mullion when the door to which the mullion is attached is opened. However, in some instances, the movable mullion may become misaligned and, as a result, may impair the sealing engagement of the doors or may inhibit the doors from opening or closing.

Accordingly, one or more elements or features for a refrigerator appliance mullion that addresses one or more of the above-described challenges would be beneficial.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet. The cabinet may define a chamber. The refrigerator appliance may include a door rotatably hinged to the cabinet for accessing the chamber. The refrigerator appliance may include an articulating mullion rotatably coupled to the door. The articulating mullion may include a body. The refrigerator appliance may include a mullion guide element adjustably attached to the body. The mullion guide element may be vertically movable relative to the body to ensure proper engagement between the mullion guide element and the cabinet.

In another exemplary aspect of the present disclosure, a refrigerator appliance is provided. The refrigerator appliance may include a cabinet that may define a chamber. The cabinet may include a front frame. The front frame may define a groove. The refrigerator appliance may include a door rotatably hinged to the cabinet and rotatable between an open position and a closed position to selectively permit access to the chamber. The refrigerator appliance may include an articulating mullion rotatably coupled to the door between a first position and a second position to selectively seal the chamber. The articulating mullion may include a body extending between a top portion and a bottom portion. The refrigerator appliance may include a mullion guide element adjustably attached to the top portion of the body. The mullion guide element may be vertically movable relative to the top portion of the body to ensure proper engagement between the mullion guide element and the groove when the door is in the closed position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
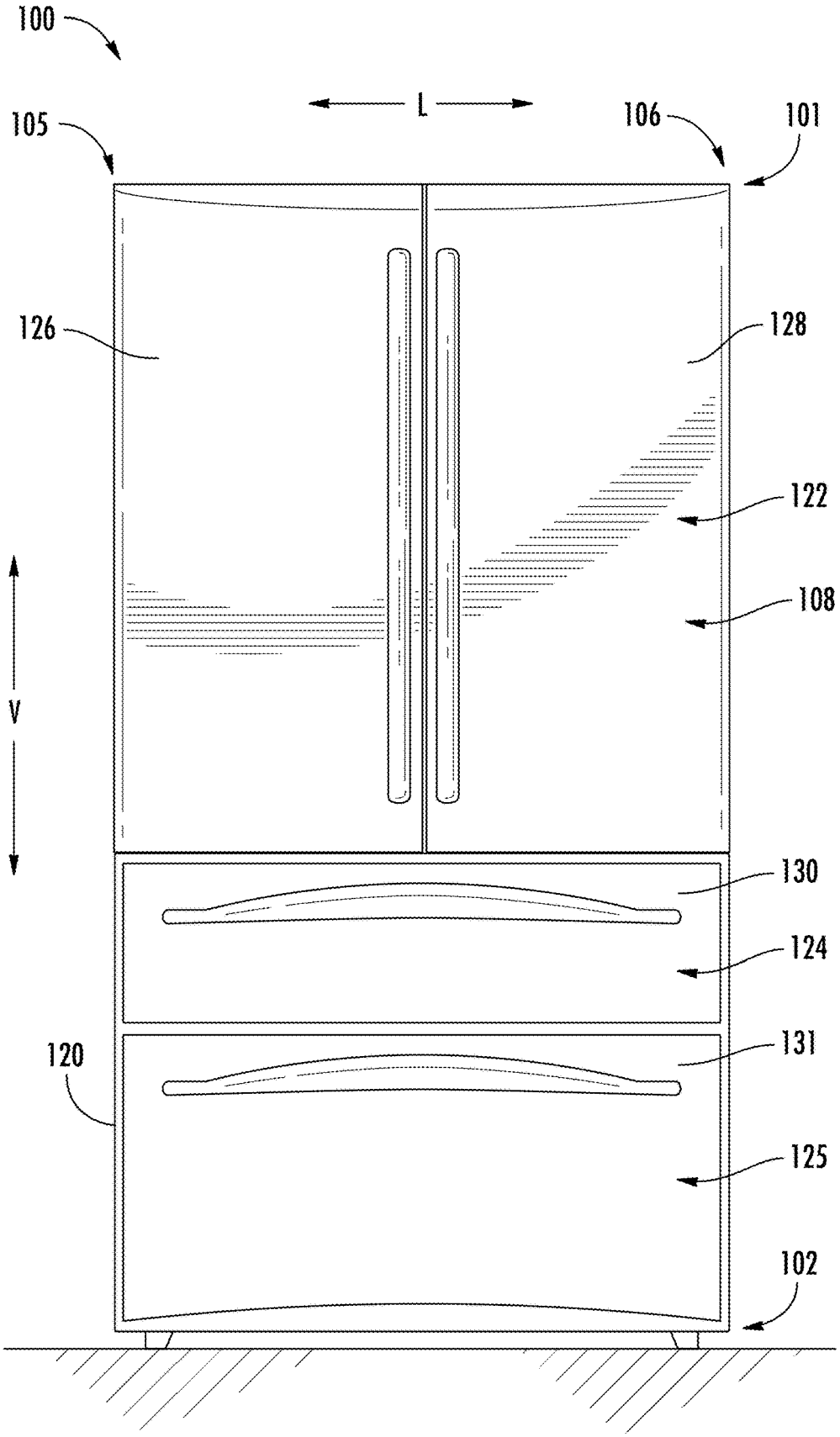
FIG. 1 provides a front view of an exemplary refrigerator appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Generally, a refrigerator appliance may be provided in some aspects of the present disclosure. The refrigerator appliance can include a cabinet defining one or more chilled chambers. One or more doors can be rotatably coupled to the cabinet to selectively provide access to the one or more chilled chambers. A door can include an articulating mullion that can prevent cooled or chilled air from flowing out of the chilled chambers of the refrigerator appliance. Articulating mullions often include mullion guide elements such as tab that are configured to interact with a corresponding groove defined by the cabinet. However, variations in manufacturing or assembly of the refrigerator appliance can result in the mullion guide element of the articulating mullion not properly engaging with the corresponding groove.

Notably, embodiments of the present subject matter provide an adjustable mullion guide element that can advantageously be raised or lowered (e.g., relative to a body of the articulating mullion) to change a vertical position of the mullion guide element. The presence of the adjustable mullion guide element advantageously improves the performance of the articulating mullion. For example, conventional articulating mullions typically have no adjustability to the positioning of the mullion guide element relative to the body of the articulating mullion. With such articulating mullions, when the mullion guide element is not properly received by the corresponding groove, the articulating mullion may not properly seal the chilled chambers of the refrigerator appliance. Thus, performance of the refrigerator appliance may be decreased. Accordingly, the adjustable mullion guide element advantageously ensures proper engagement between the articulating mullion and the cabinet not maintain or increase performance of the refrigerator appliance.

FIG. 1 provides a front view of an exemplary refrigerator appliance 100 according to an exemplary embodiment of the present disclosure. Refrigerator appliance 100 extends between a top 101 and a bottom 102 along a vertical direction V. Refrigerator appliance 100 also extends between a first side 105 and a second side 106 along a lateral direction L. Further, refrigerator appliance 100 extends between a front and a back along a transverse direction T (not shown in FIG. 1), which is a direction orthogonal to the lateral direction L. Vertical direction V, lateral direction L, and transverse direction T are mutually perpendicular and form an orthogonal direction system.

Refrigerator appliance 100 includes a housing or cabinet 120 defining a fresh food chamber 122 and one or more freezer chambers, such as a first freezer chamber 124 and a second freezer chamber 125, which may both be arranged below fresh food chamber 122 along the vertical direction V. As such, refrigerator appliance 100 may generally be referred to as a bottom mount refrigerator. Cabinet 120 also defines a mechanical compartment (not shown) for receipt of a sealed cooling system (not shown). It will be appreciated that the present subject matter can be used with other types of refrigerators appliances as well, such as e.g., side-by-side refrigerator appliances. Consequently, the description set forth herein is not intended to limit the present subject matter in any aspect.

Refrigerator doors 126, 128 are rotatably hinged to an edge of cabinet 120 for accessing fresh food chamber 122. For example, upper and lower hinges may couple each door 126, 128 to cabinet 120. It should be noted that while doors 126, 128 are configured in a "French door" configuration in FIG. 1, any suitable arrangement of doors utilizing one, two or more doors is within the scope and spirit of the present disclosure. Freezer doors, such as a first freezer door 130 and a second freezer door 131, are arranged below refrigerator doors 126, 128 for accessing one or more freezer chambers, such as first and second freezer chambers 124, 125, respectively. In the exemplary embodiment shown in FIG. 1, freezer doors 130, 131 are coupled to freezer drawers (not shown) slidably coupled within freezer chambers 124, 125. Such drawers are thus generally "pull-out" drawers in that they can be manually moved into and out of freezer chambers 124, 125 on suitable slide mechanisms. Each door 126, 128, 130, 131 can include a handle for accessing one of the chambers 122, 124, 125 of refrigerator appliance 100.

Figure 2:
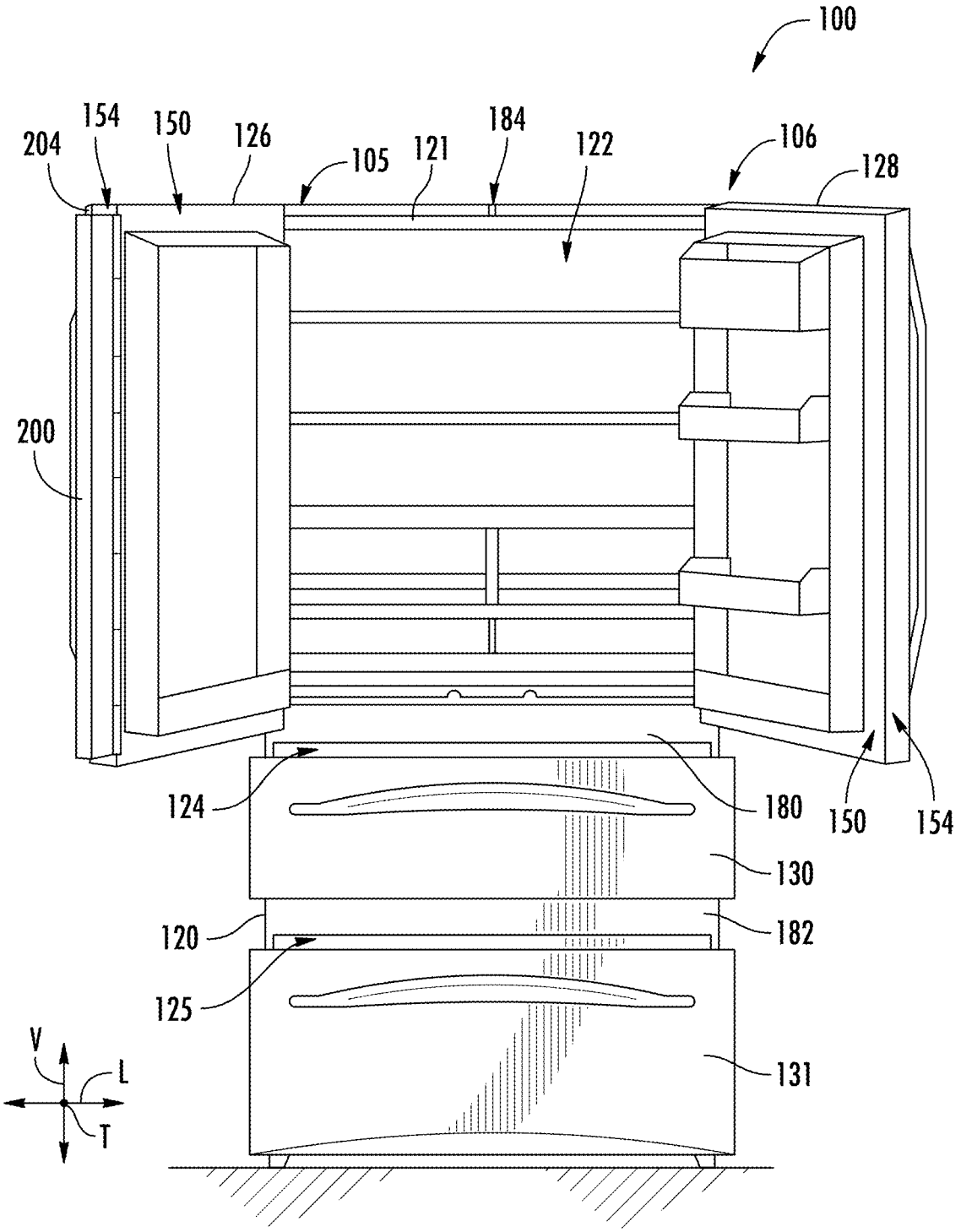
FIG. 2 provides a front view of the refrigerator appliance of FIG. 1 with refrigerator doors shown in an open configuration.

FIG. 2 provides a front perspective view of refrigerator appliance 100 showing refrigerator doors 126, 128 in an open position to reveal the interior of fresh food chamber 122. Additionally, freezer doors 130, 131 are shown in partially open positions to reveal a portion of the interior of freezer chambers 124, 125, respectively.

Figure 3:
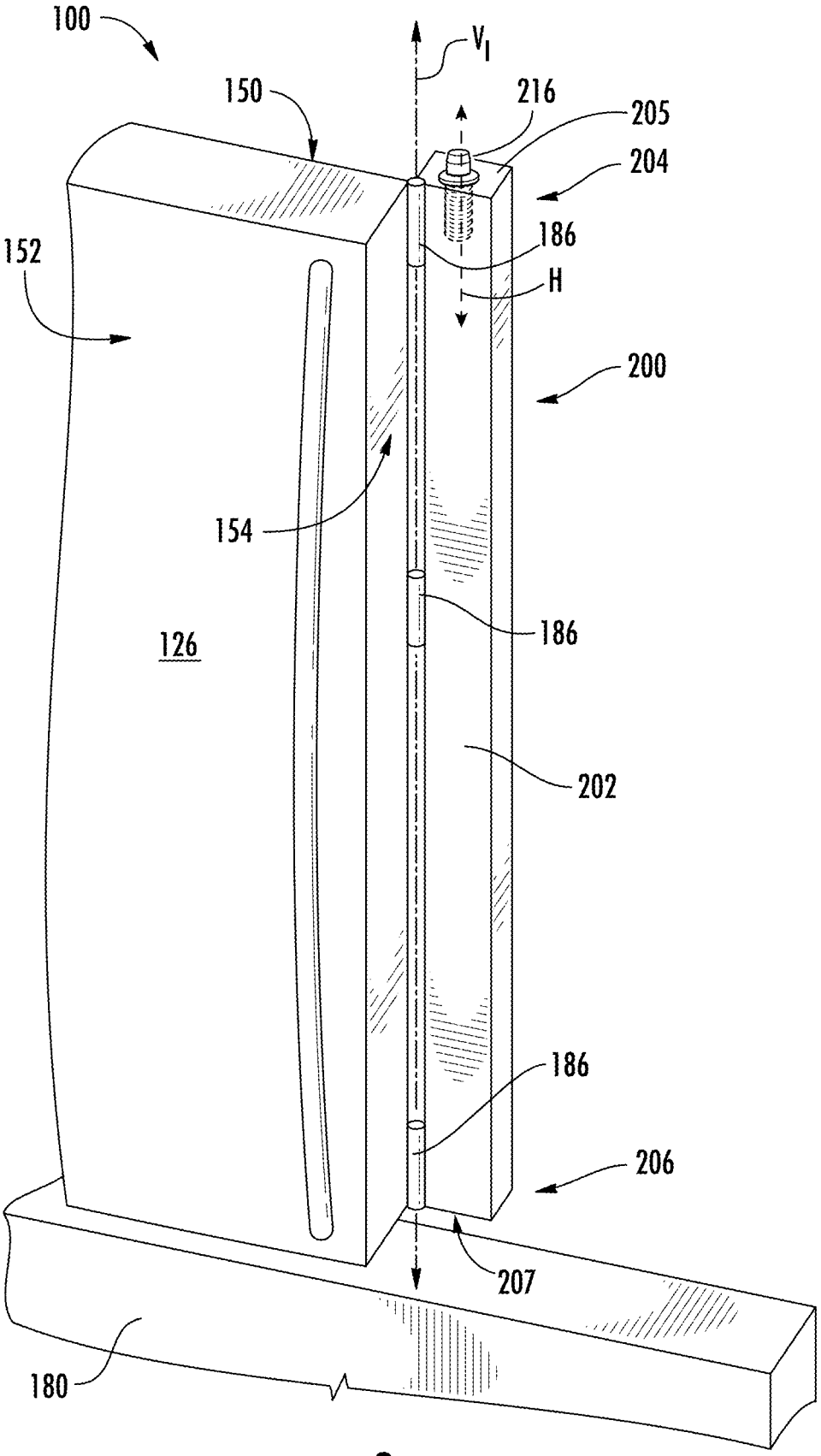
FIG. 3 provides a perspective view of a door, a stationary mullion, and an articulating mullion connected to the door of the refrigerator appliance of FIG. 1.

Door 126 of refrigerator appliance 100 includes an inner surface 150 and an outer surface 152 (FIG. 3). Inner surface 150 generally defines a portion of the interior of fresh food chamber 122 when door 126 is in a closed position as shown in FIG. 1. For instance, the inner surface 150 of the doors 126 may interface with a front frame 121 of the cabinet 120 when the door 126 is in the closed position. Outer surface 152 is generally opposite inner surface 150 and defines a portion of the exterior of refrigerator appliance 100 when door 126 is in the closed position. Door 126 includes side surfaces 154 extending between and connecting inner surface 150 and outer surface 152. It will be appreciated that door 128 can be configured in the same or similar manner as door 126. Moreover, it will further be appreciated that freezer doors 130, 131 can likewise include inner, outer, and side surfaces 150, 152, 154.

As further shown in FIG. 2, refrigerator appliance 100 includes various mullions. Mullions generally divide the various chambers of refrigerator appliance 100 or prevent leakage therefrom. For this embodiment, refrigerator appliance 100 includes a stationary mullion 180 disposed between and separating fresh food chamber 122 and first freezer chamber 124. Refrigerator appliance 100 also includes a stationary mullion 182 disposed between and separating first freezer chamber 124 and second freezer chamber 125. Stationary mullions 180, 182 generally extend along the lateral direction L between first side 105 and second side 106 of refrigerator appliance 100 and generally extend along the vertical direction V to separate the various chambers of refrigerator appliance 100. Moreover, although not shown in FIG. 2, stationary mullions 180, 182 generally extend along the transverse direction T approximately the depth of refrigerator appliance 100.

Refrigerator appliance 100 also includes an articulating mullion 200 rotatably coupled or connected to door 126 as shown in FIG. 2. In other embodiments, articulating mullion 200 can be connected to door 128. In yet other embodiments, articulating mullion 200 can be connected to any suitable door of refrigerator appliance 100. Moreover, refrigerator appliance 100 can include any suitable number of articulating mullions 200. For example, where refrigerator appliance 100 has a quad door configuration (e.g., having two rotatably mounted "French door" fresh food doors and two rotatably mounted "French door" freezer doors positioned below the fresh food doors), refrigerator appliance 100 can include one articulating mullion 200 connected to one of the freezer doors and one articulating mullion connected to one of the fresh food doors.

Referring now to FIGS. 2 through 7, the articulating mullion 200 and components thereof are described in detail herein. As illustrated in FIG. 3, the articulating mullion 200 can be rotatably coupled or rotatably hinged, via hinges 186, to door 126. Articulating mullion 200 can be rotated or articulated about a vertical axis $V_1$ (e.g., parallel to the vertical direction V) through hinges 186 as shown. Articulating mullion 200 may be rotatable about hinges 186 between a first position (e.g., corresponding to the open position of the door 126) and a second position (e.g., corresponding to a closed position of the door 126). Articulating mullion 200 can include additional hinges 186 or hinge components thereof in some exemplary embodiments.

Articulating mullion 200 may include a body 202. In some embodiments, the body 202 has a generally rectangular cross-sectional shape. It will be appreciated that the body 202 can have any suitable cross-sectional shape, such as a circular, oval, or other polygonal cross-sectional shape. Body 202 extends between a top portion 204 and a bottom portion 206 along the vertical direction V (e.g., FIG. 3), between a first end 208 and a second end 210 along the lateral direction L (e.g., FIG. 4), and between a front 212 and a rear 214 along the transverse direction T (e.g., FIG. 4). In some embodiments, the top portion 204 includes a top face 205 at the topmost portion (e.g., along the vertical direction V) of the body 202. In some embodiments, the bottom portion includes a bottom face at the bottommost portion (e.g., along the vertical direction V) of the body 202.

The articulating mullion 200 may include a mullion guide element 216 adjustably attached to the body 202. Notably, the mullion guide element 216 may be adjustable relative to the body 202 to ensure proper engagement between the articulating mullion 200 and a corresponding groove 184 (e.g., a channel or a slot) defined by the front frame 121 of the cabinet 120. Specifically, the groove 184 may be shaped and sized to receive the mullion guide element 216. When properly engaged, the corresponding groove 184 may engage with the mullion guide element 216 to transition the articulating mullion 200 between the first position and the second position or visa versa.

In some embodiments, the mullion guide element 216 is adjustably attached to the top portion 204 of the body 202. Particularly, the mullion guide element 216 may extend from the top face 205 of the top portion 204 of the body 202. The mullion guide element 216 and the body 202 of the articulating mullion 200 may define a height adjustment axis H (e.g., parallel to the vertical direction V) through the mullion guide element 216 and the body 202. The mullion guide element 216 may be vertically movable (e.g., raised or lowered along the height adjustment axis H) relative to the body 202 to ensure proper engagement between the mullion guide element 216 and the corresponding groove 184 defined in the cabinet 120.

In some embodiments, the mullion guide element 216 includes a threaded portion 250 and an engagement portion 252. For example, referring now to FIG. 6, the threaded portion 250 of the mullion guide element 216 may be positioned below the engagement portion 252 (e.g., along the height adjustment axis H). Generally, the threaded portion 250 of the mullion guide element 216 may be the portion of the mullion guide element 216 that is adjustably attached to body 202. For example, the body 202, and more particularly, the top portion 204 of the body 202 may include a complementary threaded portion. The threaded portion 250 of the mullion guide element 217 and the complementary threaded portion may be in threaded engagement with one another to selectively adjust the position (e.g., along the height adjustment axis H) of the mullion guide element 216 relative to the top portion 204 of the body. In this regard, to adjust the position of the mullion guide element 216 (e.g., relative to the top portion 204 of the body 202) the mullion guide element 216 may be motivated (e.g., by a tool or directly by a user) clockwise or counterclockwise (e.g., to lower or raise the mullion guide element 216, respectively).

Figure 5:
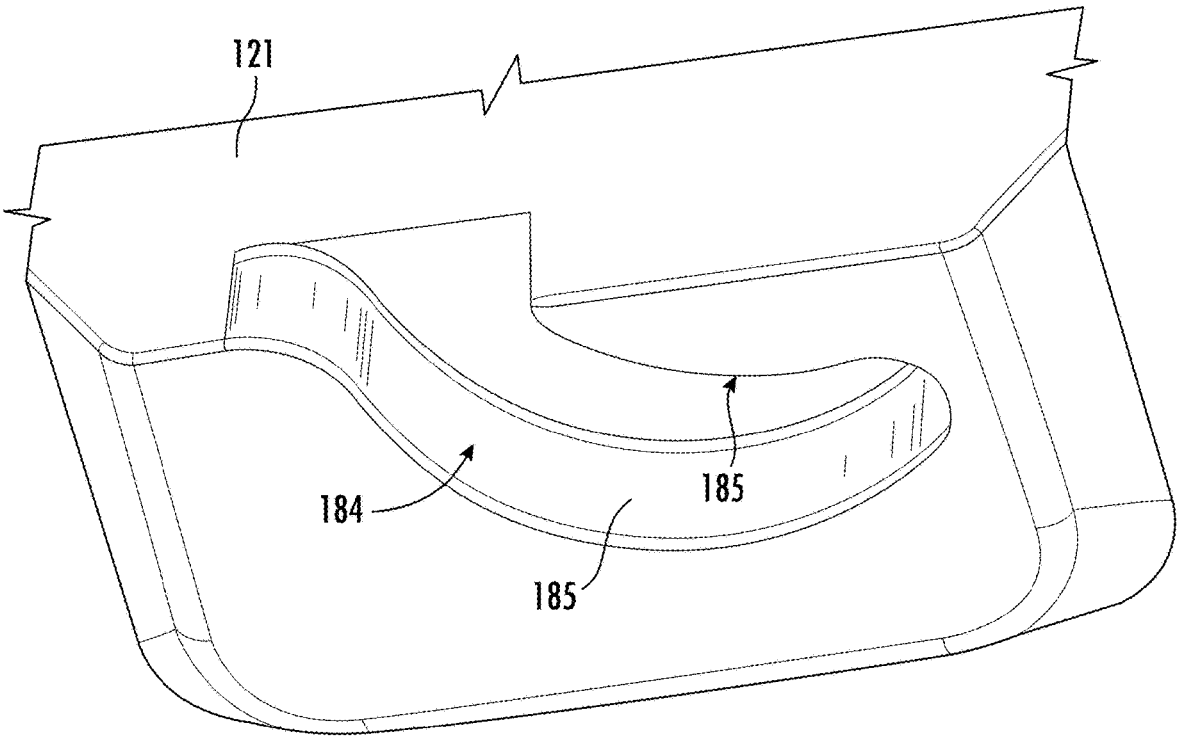
FIG. 5 provides a perspective view of a portion of a cabinet of the exemplary refrigerator appliance of FIG. 1.

Mullion guide element 216 may be sized and shaped to fit within and interact with the groove 184 defined in the front frame 121 of the cabinet 120 of refrigerator appliance 100 (e.g., FIGS. 2 and 5). In some embodiments (e.g., FIG. 5), the groove 184 includes cam surfaces 185 that may interact with mullion guide element 216 to cause rotation of articulating mullion 200 when door 126 is rotated from the closed position to the open position or vice versa.

As an illustrative example, as the door 126 is moved (e.g., between the open position and the closed position), the mullion guide element 216 may interact with the cam surfaces 185 of the groove 184. The interaction between the mullion guide element 216 and the cam surfaces 185 of the groove 184 may cause rotation of the articulating mullion 200 (e.g., about the vertical axis $V_1$) between the first position (e.g., corresponding to the open position of the door 126) and the second position (e.g., corresponding to a closed position of the door 126).

In the first position, the articulating mullion 200 may extend approximately parallel to a side surface 154 of the door 126. As the door 1236 is transitioned from the open position to the closed position, the groove 184 may receive the mullion guide element 216. When the mullion guide element 216 enters the space defined by the groove 184, the mullion guide element 216 may interact with the cam surfaces of the groove to hinge or pivot the articulating mullion 200 from the first position to the second position. In the second position, the articulating mullion may extend approximately perpendicular to the side surface 154 of the door 126. In the second position (e.g., when the door 126 is in the closed position) the articulating mullion 200 may seal the fresh food chamber 122 of the refrigerator appliance 100. When transitioning from the door 126 from the closed position to the open position, the reverse process may be executed and the articulating mullion 200 may be transitioned from the second position to the first position.

Figure 6:
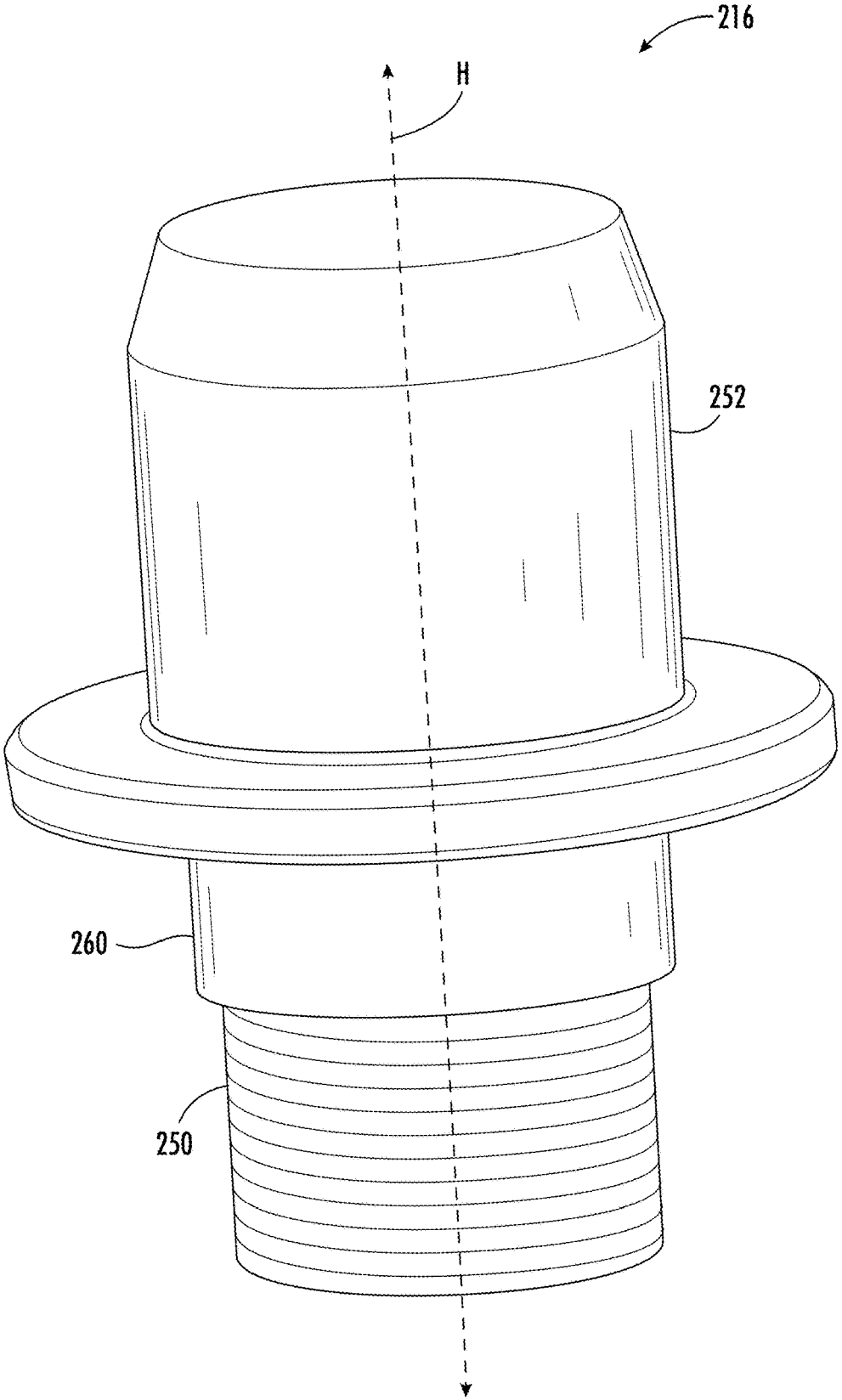
FIG. 6 provides a perspective view of a mullion guide element of an exemplary articulating mullion according to one or more exemplary embodiments of the present subject matter.

For example, the mullion guide element 216 may include a symmetric member, such as the pin illustrated in FIGS. 3 and 6. For instance, the symmetric member may generally include a symmetrical cross section, such as a circular cross-section. As another example, the mullion guide element 216 may include an asymmetric member, such as the arcuate or curved member illustrated in FIG. 7. For instance, the asymmetric member may generally include an asymmetrical cross section, such as a arcuate cross-section.

Optionally, a locking element 260 may be attached to the mullion guide element 216 to selectively lock the mullion guide element 216 at a predetermined position (e.g., along the height adjustment axis H) relative to the body 202 (e.g., relative to the top portion 204 or the bottom portion 206 of the body 202). The locking element 260 may be any suitable mechanical element that is capable of locking the mullion guide element 216 at a predetermined position relative to the body 202. For example, as illustrated in FIG. 6, the locking element 260 may include a locking nut. For instance, the locking nut may be attached to or in threaded engagement with the threaded portion 250 of the mullion guide element 216 along the height adjustment axis H. In this regard, an operator or a user of the refrigerator appliance 100 may be capable of selectively locking the threaded portion 250 of the mullion guide element 216 at a predetermined position relative to the body 202.

Figure 7:
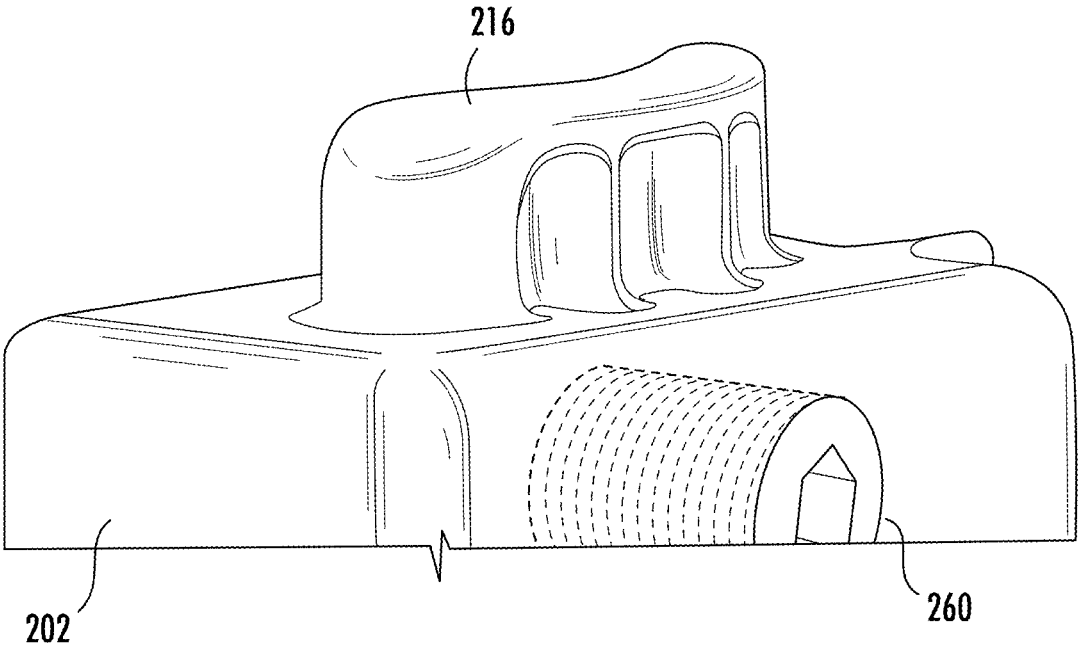
FIG. 7 provides a perspective view of a mullion guide element adjustably attached to an exemplary articulating mullion according to one or more exemplary embodiments of the present subject matter.

As another example, (e.g., as illustrated in FIG. 7), the locking element 260 may include set screw adjustably attached within the articulating mullion 200. For instance, the set screw may be extended through the body 202 of the articulating mullion perpendicular to the height adjustment axis H. The set screw may be adjustable to selectively engage with the threaded portion of the mullion guide element 216. In this regard, the set screw may be adjusted to "pinch" or selectively lock the mullion guide element 216 relative to the body 202 at a predetermined position relative to the body 202.

Additionally or alternatively, the engagement portion 252 of the mullion guide element 216 may be rotatable about an axis independent of the height adjustment axis H. For example, when the threaded portion 250 of the mullion guide element 216 is locked in place (e.g., via the locking element 260), to raise or lower a vertical position of the mullion guide element 216 (e.g., relative to the body 202), the engagement portion 252 may be rotatable relative to the threaded portion 250.

In some embodiments, the articulating mullion 200 can include an additional or alternative mullion guide element adjustably attached to the bottom portion 206 of body 202. In such embodiments, the mullion guide element 216 may be configured and may function in a similar manner to the mullion guide element 216 adjustably attached to the top portion 204 of the body. In yet some other embodiments, the articulating mullion 200 can include mullion guide elements 216 adjustably attached to both the top portion 204 and the bottom portion 206.

Figure 4:
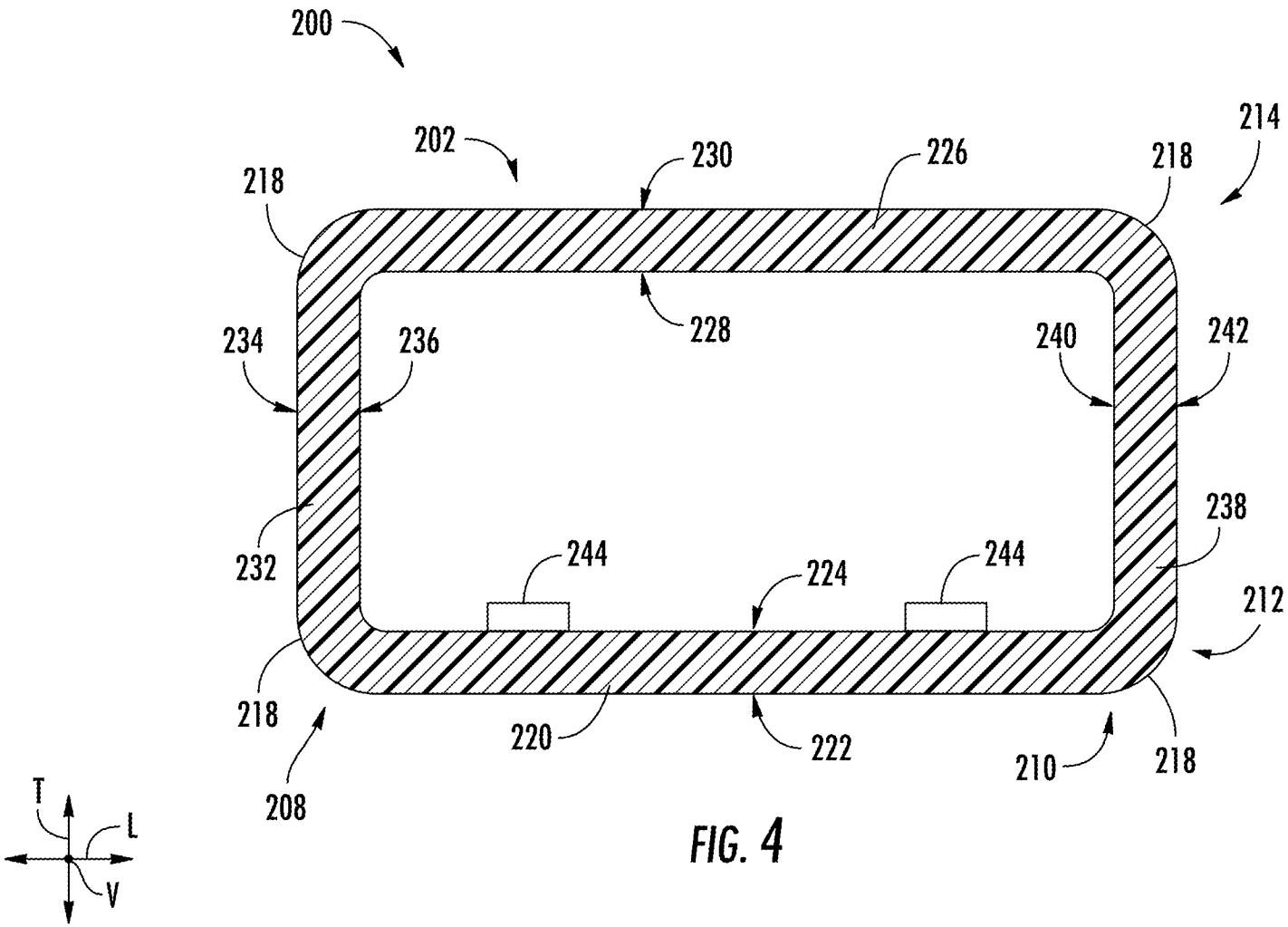
FIG. 4 is a cross-sectional view of the articulating mullion of FIG. 3.

As shown in FIG. 4, body 202 includes a front wall 220 having a front face 222 and a rear face 224 opposite front face 222. When door 126 is in the closed position, front wall 220 is oriented in a plane parallel to the vertical and lateral directions V, L. Likewise, front face 222 and rear face 224 of front wall 220 are coplanar with the vertical and lateral direction V, L. Body 202 also includes a rear wall 226 having a front face 228 and a rear face 230 opposite front face 228. Rear wall 226 extends in a plane parallel to the vertical and lateral directions V, L (when door 126 is in the closed position) and is spaced apart in the transverse direction T from front wall 220 as shown. Likewise, front face 228 and rear face 230 of rear wall 226 are coplanar with the vertical and lateral direction V, L. Front face 222 of front wall 220 faces the exterior of refrigerator appliance 100 and rear face 230 of rear wall 226 faces the interior of refrigerator appliance 100 when door 126 is in a closed position.

Body 202 further includes a first sidewall 232 having a first face 234 and a second face 236 opposite first face 234. A transition portion 218 connects first sidewall 232 with front wall 220 at first end 208 of body 202. Another transition portion 218 connects first sidewall 232 with rear wall 226 at first end 208 of body 202. First sidewall 232 extends in a plane parallel to the transverse and vertical directions T, V when door 126 is in the closed position. Body 202 also includes a second sidewall 238 having a first face 240 and a second face 242 opposite first face 240. Another transition portion 218 connects second sidewall 238 with front wall 220 at second end 210 of body 202. Another transition portion 218 connects second sidewall 238 with rear wall 226 at second end 210 of body 202. Second sidewall 238 extends in a plane parallel to the transverse and vertical directions T, V (when door 126 is in the closed position) and is spaced apart from first sidewall 232 in the lateral direction L by front and rear walls 220, 226. For this embodiment, as shown in FIG. 4, body 202 formed by front wall 220, rear wall 226, and first and second sidewalls 232, 234 has a generally hollow shape. However, in some embodiments, articulating mullion 200 can be a solid member.

In addition, as shown in FIG. 4, articulating mullion 200 also includes a heating device 244 for preventing condensation buildup on the various surfaces of body 202 of articulating mullion 200. For this embodiment, heating device 244 is a heater that includes tubular member or elements that radiate heat therefrom. In FIG. 4, two tubular members of the heater are shown. Heating device 244 can be attached to rear surface 224 of front wall 220, embedded within front wall 220, or positioned in any other suitable location. It will be appreciated, however, that heating device 244 can be any suitable type of heating device. In particular, heating device 244 can be any suitable electrically driven heating element capable of heating one or more surfaces of articulating mullion 200.

Figure 8:
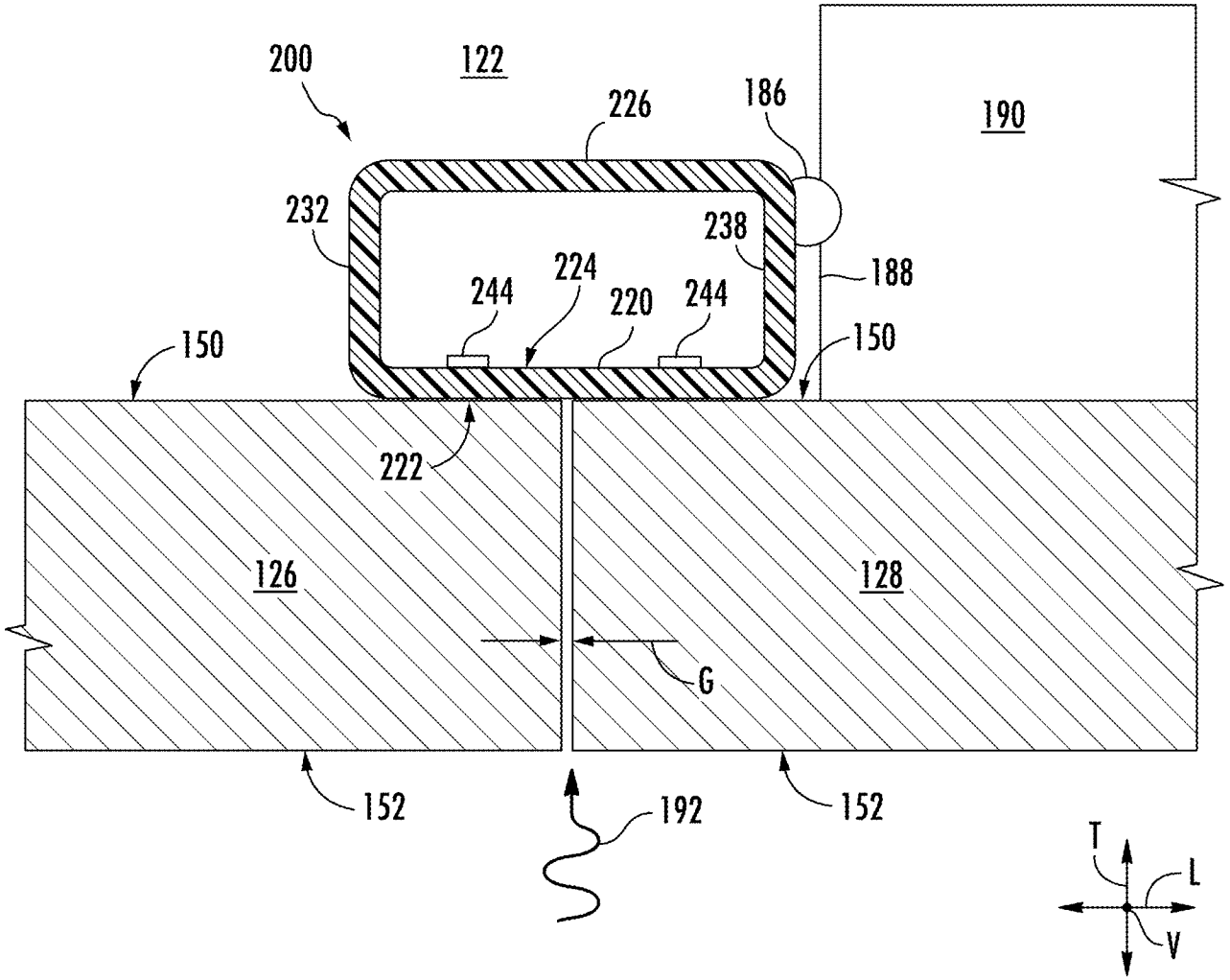
FIG. 8 provides a close-up, cross-sectional view of doors of an exemplary refrigerator appliance in a closed position and contacting an exemplary articulating mullion according to one or more exemplary embodiments of the present subject matter.

FIG. 8 provides a close-up, cross-sectional view of doors 126, 128 of exemplary refrigerator appliance 100 in a closed position and contacting articulating mullion 200 according to an exemplary embodiment of the present disclosure. For this embodiment, articulating mullion 200 is rotatably coupled or hinged to door 128 via hinge 186. In particular, articulating mullion 200 is connected to a bin wall 188 of a bin 190 of door 128. Bin 190 is connected to inner surface 150 of door 128.

As shown in FIG. 8, when doors 126, 128 are in a closed position, articulating mullion 200 is generally positioned between doors 126, 128 along the lateral direction L. Accordingly, articulating mullion 200 may prevent leakage between doors 126, 128. More specifically, when doors 126, 128 are in a closed position, a gap G is defined between doors 126, 128. Ambient air 192, which is generally warm relative to the cooled or chilled air of chambers 122, 124, 125 of refrigerator appliance 100, flows through gap G and contacts front face 222 of front wall 220 of articulating mullion 200. As articulating mullion 200 is positioned to block the airflow through gap G, articulating mullion 200 prevents relatively warm ambient air 192 from leaking into refrigerator appliance 100. Articulating mullion 200 also prevents cooled or chilled air from flowing out of refrigerator appliance 100. To prevent such leakage, inner surfaces 150 of each door 126, 128, or gaskets along such inner surfaces 150, contact front face 222 of articulating mullion 200. To hermetically seal front face 222 with doors 126, 128, each door 126, 128 (or one or more gaskets positioned along inner surfaces 150 of doors 126, 128) and articulating mullion 200 can include magnets or be formed of materials having magnetic properties to seal doors 126, 128 in sealing engagement with articulating mullion 200.

As will be appreciated, energy losses occur through conductive heat transfer across the transverse thickness (e.g., the distance from front surface 222 of front wall 220 to the rear surface 230 (e.g., FIG. 4) of rear wall 226) of articulating mullion 200 due to the temperature differential between front wall 220 and rear wall 226. And more particularly, energy losses occur through conductive heat transfer across the transverse thickness of front wall 220 due to the temperature differential between front face 222 and rear face 224 of front wall 220. Specifically, it will be appreciated that there is heat leak from relatively warm front face 222 to relatively cool rear face 224 (e.g., heat loss from the higher energy state to the lower energy state). In addition, it will be appreciated that energy losses occur through conductive heat transfer from first sidewall 232 to front wall 220 as well as from second sidewall 238 to front wall 220. In this regard, it will be appreciated that heat leak does not occur exclusively across the transverse thickness of mullion 200.

When the temperature of front face 222 is below the dew point, or dew-point temperature of the surrounding ambient air 192, the water vapor within ambient air 192 tends to condense to a liquid phase on front face 222. Stated alternatively, front face 222 begins to "sweat." In such a circumstance, heating device 244 heats front wall 220 to a predetermined temperature such that the condensed water is evaporated from front face 222. Moreover, front wall 220 is warmed to the predetermined temperature to prevent further condensation on front face 222 of front wall 220. With each use of heating device 244, refrigerator appliance 100 consumes energy, and thus, the more often heating device 244 is utilized, the less energy efficient refrigerator appliance 100 may be. As explained more fully below, various exemplary embodiments of articulating mullion 200 are provided that include features for reducing the rate of conductive heat transfer across articulating mullion 200 so that heating device 244 can be used less often. In this way, refrigerator appliance 100 may be able to achieve improved energy efficiency.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a chamber;

a door rotatably hinged to the cabinet for accessing the chamber;

an articulating mullion rotatably coupled to the door, the articulating mullion comprising a body comprising a complementary threaded portion; and a mullion guide element adjustably attached to the body, the mullion guide element defining a height adjustment axis, the mullion guide element comprising a threaded portion and an engagement portion, the threaded portion positioned below the engagement portion along the height adjustment axis, wherein the threaded portion of the mullion guide element and the complementary threaded portion of the body are in threaded engagement, wherein mullion guide element is vertically moveable relative to the body via the threaded engagement between the threaded portion of the mullion guide element and the complementary threaded portion of the body, and wherein the engagement portion is rotatable about an axis independent to the height adjustment axis to adjust a vertical position of the mullion guide element relative to the body.

2. The refrigerator appliance of claim 1, wherein the cabinet defines a groove, and wherein the mullion guide element is selectively received within the groove.

3. The refrigerator appliance of claim 2, wherein the groove comprises cam surfaces, and wherein the mullion guide element is positioned within the cam surfaces of the groove in a closed position of the door.

4. The refrigerator appliance of claim 1, further comprising:

a locking nut attached to the mullion guide element to selectively lock the mullion guide element at a predetermined position relative to the body, wherein the locking nut is attached to the threaded portion of the mullion guide element along the height adjustment axis, and wherein the threaded portion of the mullion guide element is selectively locked relative to the body at a predetermined position relative to the body via the locking nut.

5. The refrigerator appliance of claim 1, further comprising:

a set screw adjustably attached to the articulating mullion to selectively lock the mullion guide element at a predetermined position relative to the body, wherein the set screw is extended through the mullion guide element perpendicular to the height adjustment axis, wherein the set screw is adjustable to selectively engage with the threaded portion of the mullion guide element, and wherein the mullion guide element is selectively locked relative to the body at a predetermined position relative to the body via the engagement between the set screw and the threaded portion of the mullion guide element.

6. The refrigerator appliance of claim 1, wherein the body is extended between a top portion and a bottom portion, wherein the mullion guide element adjustably attached to the top portion of the body.

7. The refrigerator appliance of claim 6, wherein the mullion guide element is a first mullion guide element adjustably attached to the top portion of the body, wherein the refrigerator appliance further comprises a second mullion guide element, wherein the second mullion guide element is adjustably attached to the bottom portion of the body, and wherein the second mullion guide element is vertically moveable relative to the bottom portion of the body to ensure proper engagement between the second mullion guide element and the cabinet.

8. The refrigerator appliance of claim 1, wherein the mullion guide element includes a symmetric member, wherein the symmetric member is adjustably attached to the body, and wherein the symmetric member defines a symmetrical cross-section.

9. The refrigerator appliance of claim 1, wherein the mullion guide element includes an arcuate member, wherein the arcuate member is adjustably attached to the body, and wherein the arcuate member defines an asymmetric cross-section.

10. A refrigerator appliance comprising;

a cabinet defining a chamber, the cabinet comprising a front frame, the front frame defining a groove;

a door rotatably hinged to the cabinet and rotatable between an open position and a closed position to selectively permit access to the chamber;

an articulating mullion rotatably coupled to the door between a first position and a second position to selectively seal the chamber, the articulating mullion comprising a body extending between a top portion and a bottom portion, the top portion of the body comprising a complementary threaded portion; and a mullion guide element adjustably attached to the top portion of the body, the mullion guide element defining a height adjustment axis, the mullion guide element comprising a threaded portion and an engagement portion, the threaded portion positioned below the engagement portion along the height adjustment axis, wherein the threaded portion of the mullion guide element and the complementary threaded portion of the top portion of the body are in threaded engagement, wherein the mullion guide element is vertically moveable relative to the top portion of the body via the threaded engagement between the threaded portion of the mullion guide element and the complementary threaded portion of the top portion of the body, and wherein the engagement portion is rotatable about an axis independent to the height adjustment axis to adjust a vertical position of the mullion guide element relative to the body.

11. The refrigerator appliance of claim 10, wherein the groove comprises cam surfaces, and wherein the mullion guide element is positioned within the cam surfaces of the groove in the closed position.

12. The refrigerator appliance of claim 10, further comprising:

a locking nut attached to the mullion guide element to selectively lock the mullion guide element at a predetermined position relative to the body, wherein the locking nut is attached to the threaded portion of the mullion guide element along the height adjustment axis, and wherein the threaded portion of the mullion guide element is selectively locked relative to the body at a predetermined position relative to a top portion of the body via the locking nut.

13. The refrigerator appliance of claim 10, further comprising:

a set screw adjustably attached to the articulating mullion to selectively lock the mullion guide element at a predetermined position relative to the body, wherein the set screw is extended through the mullion guide element perpendicular to the height adjustment axis, wherein the set screw is adjustable to selectively engage with the threaded portion of the mullion guide element, and wherein the mullion guide element is selectively locked relative to the body at a predetermined position relative to the top portion of the body via the engagement between the set screw and the threaded portion of the mullion guide element.

14. The refrigerator appliance of claim 10, wherein the mullion guide element is a first mullion guide element adjustably attached to the top portion of the body, wherein the refrigerator appliance further comprises a second mullion guide element, and wherein the second mullion guide element is adjustably attached to the bottom portion of the body, and wherein the second mullion guide element is vertically moveable relative to the bottom portion of the body to ensure proper engagement between the second mullion guide element and the cabinet.

15. The refrigerator appliance of claim 10, wherein the mullion guide element includes a symmetric member, wherein the symmetric member is adjustably attached to the body, and wherein the symmetric member defines a symmetrical cross-section.

16. The refrigerator appliance of claim 10, wherein the mullion guide element includes an arcuate member, wherein the arcuate member is adjustably attached to the body, and wherein the arcuate member defines an asymmetric cross-section.

* * * * *